United States Patent [19]

Shishkin et al.

[11] Patent Number: 4,770,614

[45] Date of Patent: Sep. 13, 1988

[54] APPARATUS FOR TRANSFERRING FLUID MEDIUM

[76] Inventors: Viktor V. Shishkin, ulitsa Festivalnaya, 16, kv. 5; Nikolai F. Kryazhevskikh, ulitsa Krasnykh Partizan, 559, kv. 13; Jury P. Shapovalov, ulitsa Turgeneva, 18, all of Krasnodar, U.S.S.R.

[21] Appl. No.: 110,707

[22] PCT Filed: Dec. 19, 1986

[86] PCT No.: PCT/SU86/00137

§ 371 Date: Jul. 16, 1987

§ 102(e) Date: Jul. 16, 1987

[87] PCT Pub. No.: WO87/03935

PCT Pub. Date: Jul. 2, 1987

[30] Foreign Application Priority Data

| | | | |
|---|---|---|---|
| Dec. 24, 1985 | [SU] | U.S.S.R. | 3988730 |
| Dec. 24, 1985 | [SU] | U.S.S.R. | 3988732 |
| Dec. 24, 1985 | [SU] | U.S.S.R. | 3988733 |
| Dec. 24, 1985 | [SU] | U.S.S.R. | 3988738 |
| Dec. 24, 1985 | [SU] | U.S.S.R. | 3988740 |
| Dec. 24, 1985 | [SU] | U.S.S.R. | 3988747 |
| Dec. 24, 1985 | [SU] | U.S.S.R. | 3988751 |

[51] Int. Cl.[4] ..... F04B 43/06; F04B 47/04

[52] U.S. Cl. ..... 417/480; 417/514; 417/550

[58] Field of Search ..... 417/437, 474, 394, 550, 417/479, 480, 572, 514; 92/92, 91, 90

[56] References Cited

U.S. PATENT DOCUMENTS

| | | | |
|---|---|---|---|
| 87 | 11/1836 | Card | 92/92 |
| 508,225 | 11/1893 | Knoche | 417/437 |
| 562,285 | 6/1896 | Delpeyrov | 417/480 |
| 4,111,616 | 9/1978 | Rankin | 417/480 X |

FOREIGN PATENT DOCUMENTS

| | | | |
|---|---|---|---|
| 1040375 | 3/1959 | Fed. Rep. of Germany . | |
| 641180 | 1/1979 | U.S.S.R. . | |
| 918590 | 4/1982 | U.S.S.R. | 417/394 |
| 1084419 | 4/1984 | U.S.S.R. . | |
| 1174592 | 8/1985 | U.S.S.R. . | |

OTHER PUBLICATIONS

Elektrosvyaz, N3, 3/1973, (Svyaz Moscow), G. Z. Aizenberg et al.,"Pnevmaticheskie antenny", p.24, figure 7.

*Primary Examiner*—Leonard E. Smith

*Attorney, Agent, or Firm*—Burgess, Ryan And Wayne

[57] ABSTRACT

An apparatus for transferring a fluid medium comprises a housing (1) having an interior (4) in the top portion (2) thereof communicating through selector valves (5,9) with the atmosphere and with an intake line (6), the bottom portion 3) of the housing (1) accommodating an actuator 13) capable of reciprocations relative this bottom portion of the housing and blocking its cross-section, the actuator (13) having a non-return valve to communicate a tank (12) containing the fluid medium with the interior of the housing 1) at the top portion (2) thereof. The actuator with the non-return valve is fashioned as an elastic hose (13) one end of which is attached to the periphery of the wall of the bottom portion (3) of the housing (1), whereas the other end is connected pivotably through link elements (14) equidistantly secured to its perimeter to a flexible pull member (15) extending through the hose (13) and connected to a drive to ensure the movement of the second end of the hose toward the top portion (2) of the housing (1), this second end of the hose tending to draw together in the course of such movement, the interior of the top portion (2) of the housing (1) communicating further with a source (8) of compressed gas to provide the movement of the second end of the hose (13) in a reverse direction.

9 Claims, 8 Drawing Sheets

APPARATUS FOR TRANSFERRING FLUID MEDIUM

FIELD OF THE INVENTION

This invention relates to pump construction, and more particularly concerns apparatus for transferring fluid media.

BACKGROUND OF THE INVENTION

There is known an apparatus for lifting a liquid from a well comprising a housing formed by a pipe string run into the well. This housing accommodates an actuator in the form of plunger having a non-return valve. The upper part of the housing overlying the plunger communicates through selector valves with an intake line. The plunger is capable of reciprocating inside the pipe for which purpose it is connected through a flexible pull member with a drum the shaft of which is kinematically linked with the shaft of an electric motor (cf., e.g., USSR Inventor's Certificate No. 1,084,419 published in Russian in the Bulletin "Discoveries, Inventions, Industrial Designs, Trademarks" Apr. 7, 1984).

One inherent disadvantage of the above apparatus is failure to deliver a relatively large quantity of the fluid medium with one stroke of the plunger to a relatively long distance, since reliable sealing of the plunger with respect to the housing is virtually impossible. To ensure a high degree of such sealing, the inside surface of the string of pipes needs precise machining, which makes their fabrication too expensive. This prior art apparatus is therefore not sufficiently reliable or efficient, and features a rather short service life.

SUMMARY OF THE INVENTION

The invention aims at providing such an apparatus for transmitting a fluid medium, in which an actuator would be structurally simple to ensure lifting water from any depth in large quantities The aims of the invention are attained by that in an apparatus comprising a housing with an interior in the top portion thereof communicating through selector valves with the atmosphere and with an intake line, the bottom portion of the housing accommodating a working member or actuator capable of reciprocating relative to the bottom portion of the housing and blocking its cross-section, the actuator having a non-return valve communicating a tank containing a fluid medium with the interior of the housing in the top portion thereof, according to the invention, the actuator with the non-return valve is fashioned as an elastic hose one end of which is hermetically attached to the perimeter of the wall of the bottom portion of the housing, whereas the second end thereof is pivotably connected through link elements equidistantly secured to its perimeter to a flexible pull member extending through the elastic hose and connected to a drive means to ensure that the second end of the elastic hose can move toward the top portion of the housing, this second end of the hose tending to draw together in the course of such movement, the interior of the top portion of the housing communicating with a source of compressed gas to provide the movement of the second end of the elastic hose in the reverse direction.

Preferably, the bottom portion of the housing is longer than the stroke of the elastic hose, and is separated from the tank containing the fluid medium by a filtering element.

Such an arrangement allows to transfer liquids carrying any amounts of contaminants.

Advisably, the bottom portion of the housing is closed, and communicates with the tank containing the fluid medium through a suction valve, a by-pass pipe being preferably provided one end of which is connected through a pressure valve to the intake line, whereas the other end is connected to the bottom portion of the housing in proximity to the suction valve.

This enables an increase in the operation efficiency of the proposed apparatus thanks to dispensing with the idle stroke of the actuator.

Alternatively, the suction valve can be provided with a filtering element.

This arrangement affords to transfer highly contaminated liquids and to periodically wash the filter during the idle stroke of the hose.

Preferably, in a modified form of the proposed apparatus in which the drive means for moving the second end of the elastic hose includes an electric motor and a drum shaft connected to the electric motor for reeling-on the flexible pull member and elastic hose, the drum shaft is hollow with this hollow of the drum communicating with the intake line, whereas the by-pass pipe is flexible to extend through the elastic hose, one end of the flexible bypass pipe being preferably disposed below the second end of the elastic hose, the other end thereof communicating with the hollow of the drum shaft.

Such a construction is advantageous because it adds to the operation efficiency and simplicity of the apparatus.

Preferably, the second end of the by-pass pipe is connected to the bottom portion of the housing somewhat above the level at which the second end of the elastic hose rests in the fully extended position of the hose.

This arrangement enables to transfer the liquid both in the forward and reverse strokes of the actuator accompanied by filter washing to result in higher output capacity of the apparatus.

Preferably, two sections for transferring a fluid medium of the proposed apparatus have a drive means for moving the hoses toward the top of the housing provided with two drums each arranged in a respective housing, the drum shafts being coaxially arranged and kinematically interconnected, one of the shafts being connected to an electric motor.

This alternative modification of the proposed apparatus affords a saving in the amount of power to be consumed for the fluid transferring process and are increase in the quantity of liquid being transferred accompanied by reduced flow pulsation in the intake line.

Preferably, the bottom portion of the housing is separated from the top portion by a hermetically sealed partition wall, whereas the drive means for moving the second end of the elastic hose is fashioned as an additional elastic hose one end of which is turned inside out and attached to the periphery of the top portion of the housing, the second end of this hose being preferably threaded through the hermetically sealed partition wall and connected to one end of the flexible pull member having the second end thereof connected to the elastic hose, the cavities defined between the hermetically sealed partition wall and elastic hose communicating with the atmosphere and with the source of compressed gas.

This simplifies the construction and increases the output capacity of the apparatus.

It is also preferable that the top portion of the housing above the additional elastic hose would form a hermetically sealed interior communicating with the tank containing the fluid medium and with the intake line.

Such an arrangement still further increases the liquid transfer efficiency of the proposed apparatus.

In view of the aforedescribed, the proposed apparatus for transferring a fluid medium, while being relatively simple in construction, offers a substantially higher output capacity, reliability and longer service life. Also, fabrication of the proposed apparatus requires less precise machining. The apparatus is therefore suitable for a wider range of applications, since it can pump both clean and contaminated liquids from deep holes and open reservoirs.

BRIEF DESCRIPTION OF THE DRAWINGS

The invention will now be described in greater detail with reference to various preferred embodiments thereof taken in conjunction with the accompanying drawings, in which.

BEST MODE OF CARRYING OUT THE INVENTION

Figure 1:
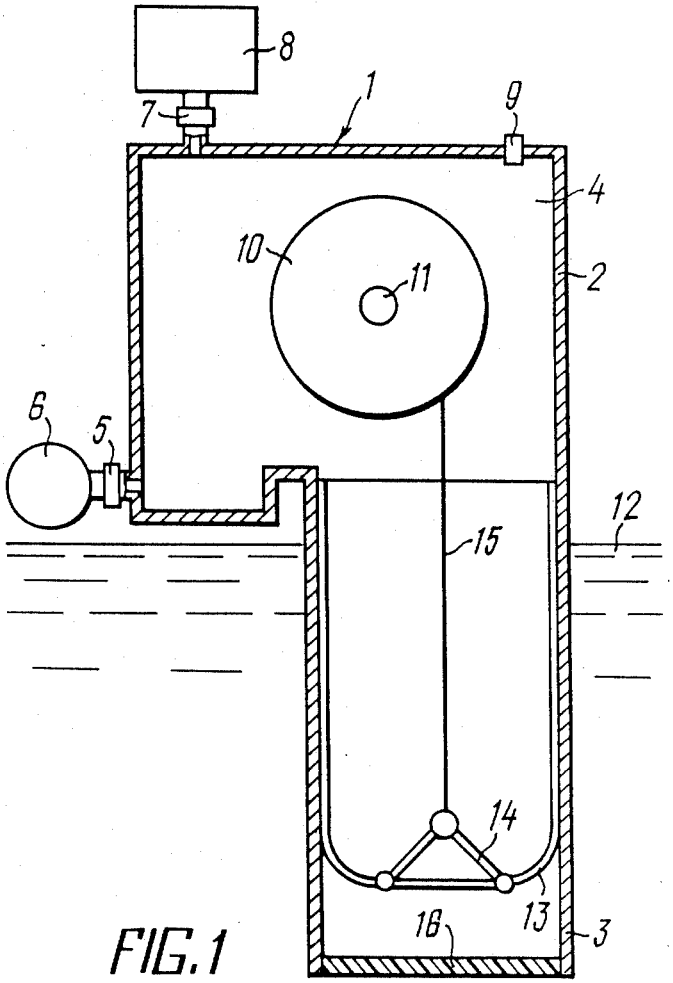
FIG. 1 is a schematic representation of an apparatus for transferring a fluid medium according to the invention.

With reference to FIG. 1, an apparatus for transferring a fluid medium comprises a housing 1, which includes a top portion 2 and a bottom portion 3. An interior 4 defined by the top portion 2 of the housing 1 communicates through a selector valve 5 with an intake line 6, and through a selector valve 7 with a source of compressed gas indicated at 8. Another valve 9 is provided through which the interior 4 communicates with the atmosphere. The top portion 2 of the housing 1 also accommodates a drum 10 having a shaft 11 thereof kinematically linked with an electric motor (not shown) through a freewheel clutch (not shown). The bottom portion 3 of the housing 1 is immersed in tank 12 containing a fluid medium, viz., liquid. This bottom portion 3 of the housing 1 accommodates an actuator 13 having the form of an elastic hose hereinafter referred to as the hose indicated by the same reference numeral 13.

The hose 13 has one end thereof turned inside out and attached to the periphery of the inside wall of the bottom portion 3 of the housing 1. The other end of the hose 13 is open and through links 14 spaced equidistantly about its perimeter is pivotably connected to a flexible pull member 15 extending lengthwise of the hose 3 and having the other end thereof connected to the drum 10 to move this second end of the hose upwards toward the top portion 3 of the housing 1. In the course of the upward travel of the second end of the hose 13 its walls tend to draw together and form a closed cavity, in other words they function as a non-return valve. A compressed gas fed through the selector valve 7 from the compressed gas source 8 acts to return the second end of the hose 13 to the initial, that is unfolded or open position.

In the embodiment now described the bottom portion 3 of the housing 1 has a length greater than the travel path of the hose, i.e., this portion 3 of the housing 1 extends below the second end of the hose 13. The portion 3 is also separated from the tank 12 by a filtering element 16. The provision in the bottom portion of the housing 1 of the filtering element makes the apparatus applicable for transferring contaminated industrial and farm production sewage water (e.g., fical water).

In order to make the apparatus operate more efficiently, a bottom portion 17 of the housing 18 (FIG. 2) is closed, and communicates with the tank 12 through a suction valve 19 having a filtering element 20. The intake line 6 communicates via a by-pass pipe 21 having a pressure valve 22 with the bottom portion 17 of the housing 18. The end of the by-pass pipe 21 is connected to the bottom portion 17 of the housing 18 in proximity to the suction valve 19 below the second end of the hose 13 in the fully extended or unfolded position thereof.

Figure 3:
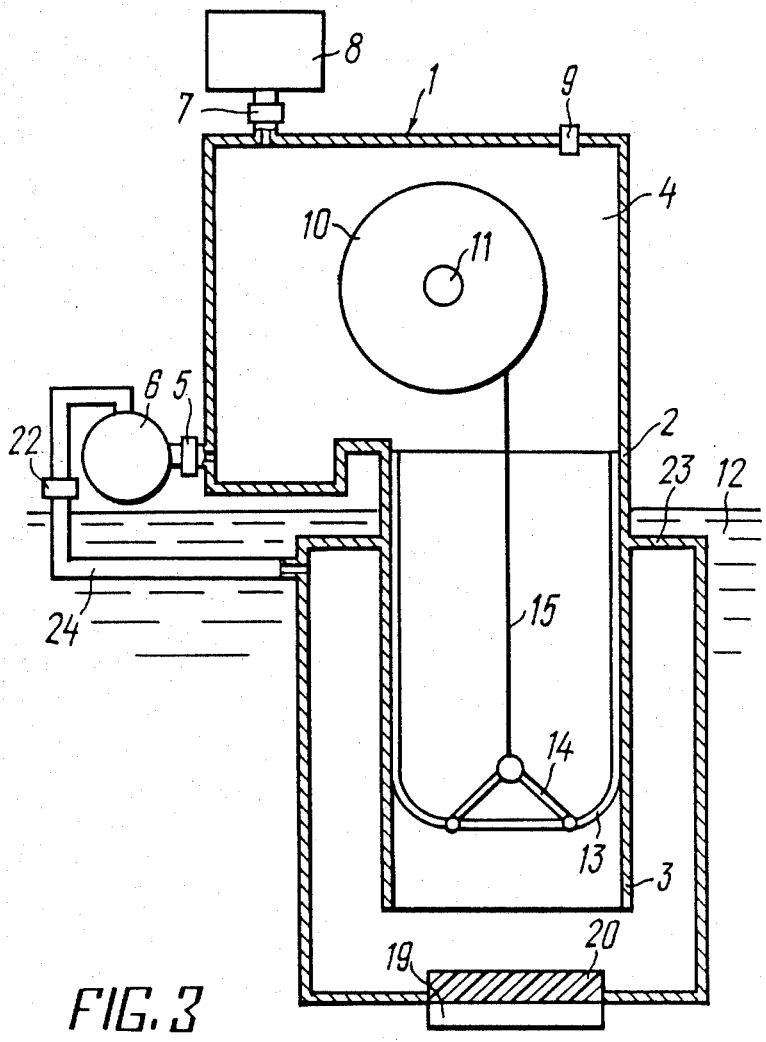

With reference to FIG. 3, in another modified form of the apparatus the lower portion 3 of the housing 1 is accommodated inside a vessel 23 communicating through the suction valve 19 having the filter 20 with the tank 12. A by-pass pipe 24 is connected by one end thereof to the vessel 23, and by the other end to the intake line 6 via the pressure valve 22. This arrangement is preferable for transferring fecal wastes, in chemical plants or in public utilities.

Figure 4:
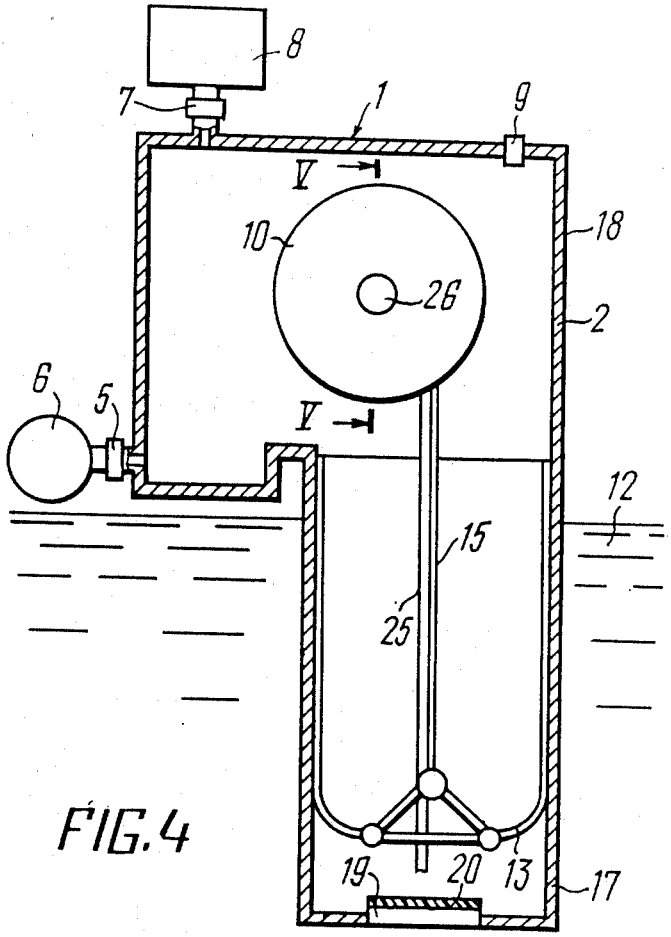
FIG. 4 is a modified form of the proposed apparatus with a flexible by-pass pipe.

In a modified form of the proposed apparatus shown in FIG. 4 a by-pass pipe 25 is flexible, extending through the elastic hose 13 lengthwise of the flexible pull member 15.

Figure 5:
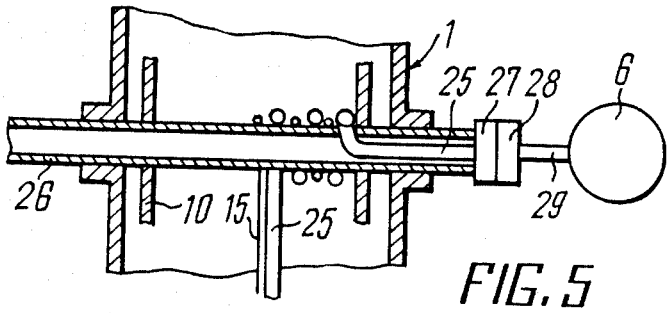
FIG. 5 is a section taken along the line V—V in FIG. 4.

With reference to FIG. 5, a shaft 26 of the drum 10 is hollow to communicate through rotatable and fixed couplings 27 and 28, respectively, and through a pipe 29 with the intake line 6. One end of the by-pass pipe 25 projects below the second end of the elastic hose 13 (FIG. 4), whereas the second end thereof extends to the hollow of the shaft 26 and communicates through the couplings 27 and 28 with the pipe 29.

For a more thorough washing of the filtering elements 20 (FIG. 6) of the suction valve 19 a by-pass pipe 30 is connected to the bottom portion 17 of the housing 18 somewhat above the second end of the elastic hose 13 in its lowest unfolded position.

Figure 6:
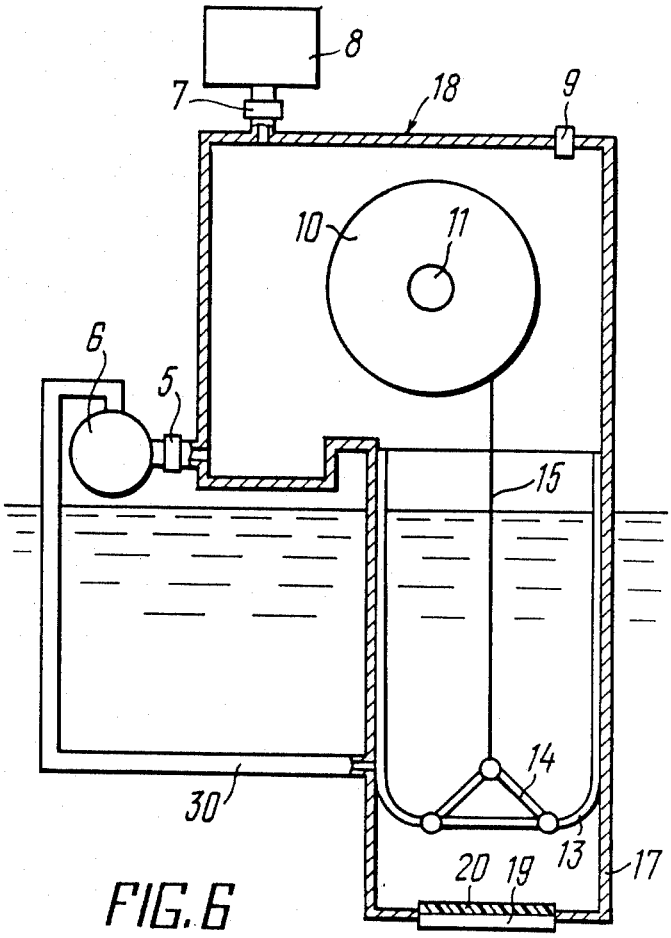
FIG. 6 is a schematic representation of the apparatus according to the invention in which the point of connection of the by-pass pipe to the bottom portion of the housing is blocked by a hose.
Figure 7:
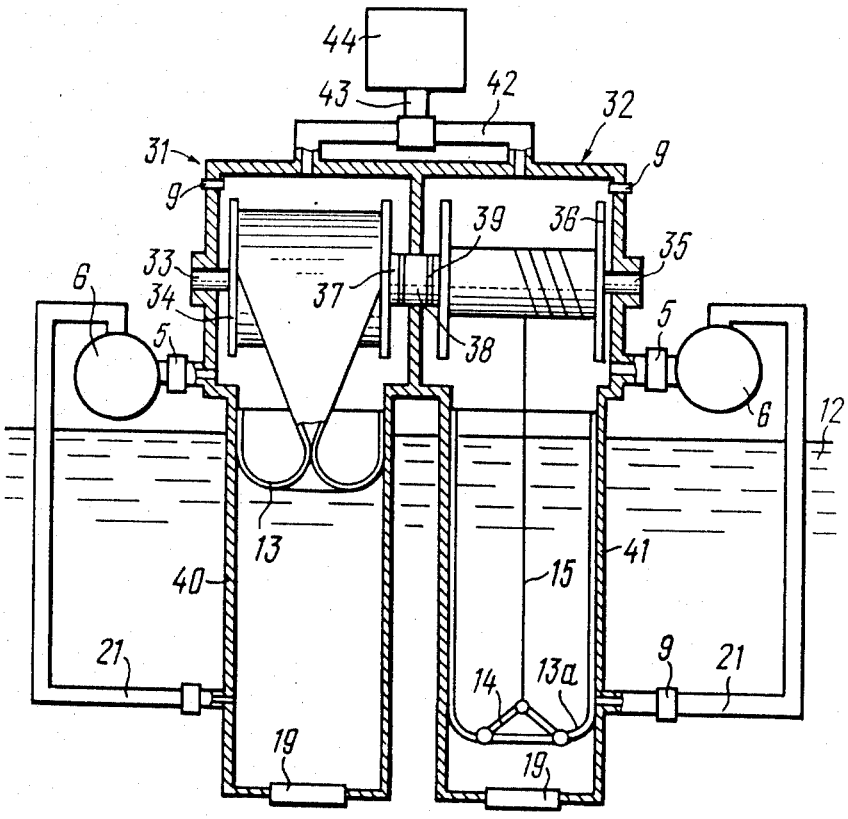
FIG. 7 shows one more modified form of the proposed apparatus.

FIG. 7 illustrates a modification of the proposed apparatus for transferring a fluid medium, which includes two adjacent substantially identical fluid transferring sections 31 and 32 arranged similarly to what has been described with reference to FIG. 6. In these sections 31 and 32 a shaft 33 of a drum 34 of the section 31 and a shaft 35 of a drum 36 of the section 32 are disposed coaxially and interconnected by half-couplings 37, 38 and 39 enabling to execute alternate rotation of the shafts 33 and 35 so that while the hose 13 of the section 31 rests in the top position, the hose 13*a* of the section 32 stays in the lowest or fully unfolded position. One of these shafts is kinematically linked with an electric motor (not shown).

In this embodiment of the proposed apparatus the interiors of the upper portions of the housings 40 and 41 communicate through a pipe 42 and selector valve 43 with a common source 44 of compressed gas. The provision of two or more such sections increases the output capacity of the apparatus and reduces the amount of power consumed for transferring a fluid medium, since the torque is transmitted from the electric motor alternately to shafts 33 and 35 of the drums 34 and 36.

Figure 8:
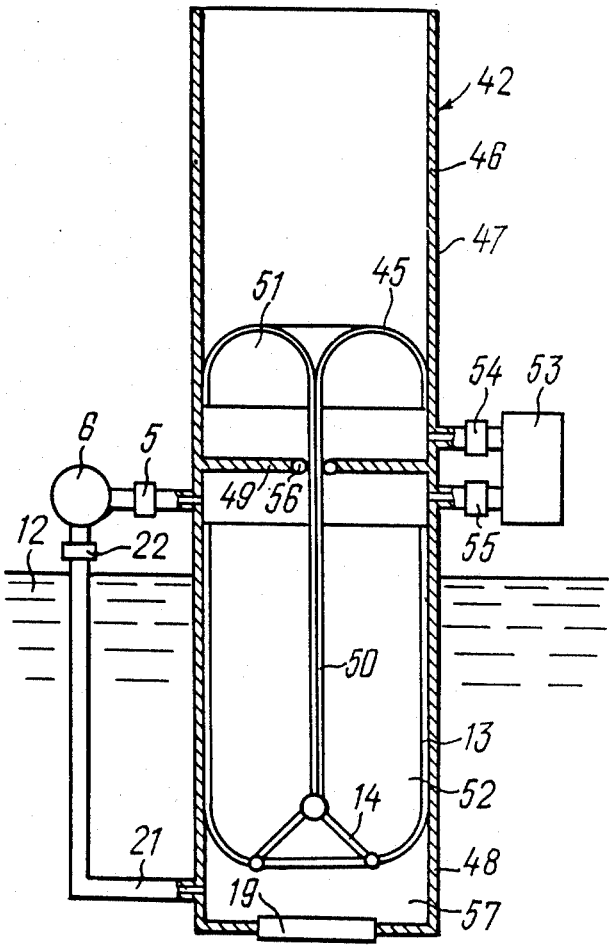
FIG. 8 is a view of the proposed apparatus with an additional elastic hose.

With reference to FIG. 8, a still further structural simplification of the proposed apparatus for transferring a liquid medium is attained by that an additional hose 45 serves as a drive for moving the second end of the hose 13. This additional hose 45 occupies an upper portion 46 of a housing 47 separated from a bottom portion 48 by a hermetically sealed partition wall 49 and is connected to one end of a flexible pull member 50 the other end of which is pivotably connected to ends of the links 14, other ends of the links 14 being pivotally connected to the second end of the hose 13. Cavities 51 and 52 formed between the hermetically sealed partition wall 49, as well as between the additional hose 45 and hose 13 communicate with a source 53 of compressed gas through selector valves 54 and 55, respectively.

The hole in the hermetically sealed partition wall 49 wherethrough the end of the additional hose 45 is threaded has a sealing member 56. The cavities 51 and 52 communicate with the atmosphere through valves 54 and 55, respectively. The cavity 52 communicates through the selector valve 5 with the intake line 6, which in turn communicates through the by-pass pipe 21 and pressure valve 22 with an interior 57 between the second end of the hose 13 and the bottom of the housing 47.

Figure 9:
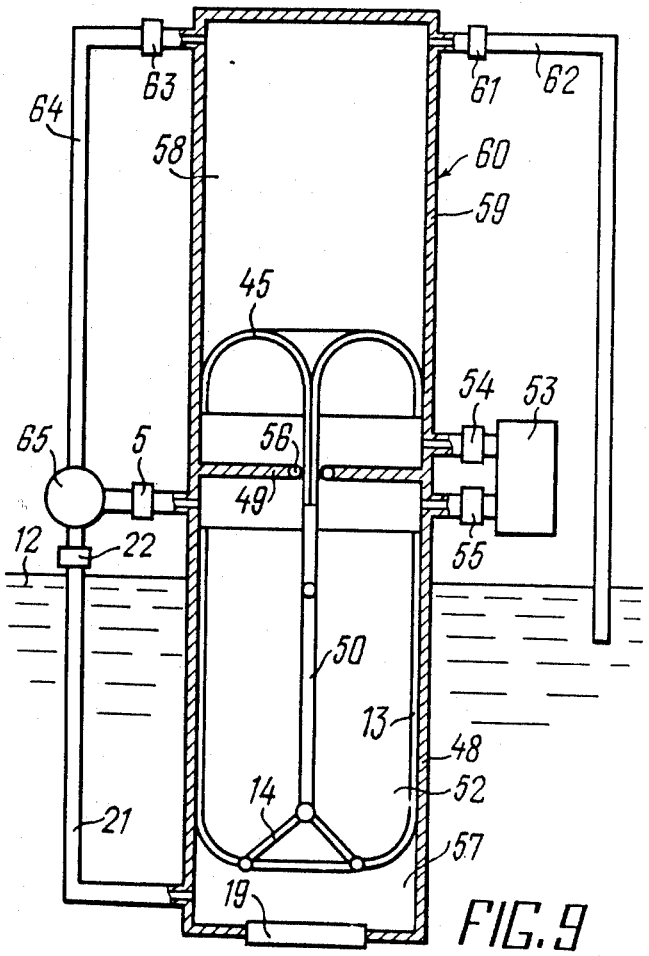
FIG. 9 shows substantially the same as illustrated in FIG. 8 with a hermetically sealed interior in the top portion of the housing.

Referring now to FIG. 9, a higher efficiency of fluid media transfer through dispensing with an idle stroke and displacing the medium by both hoses 45 and 13 is attained by that a top portion 59 of a housing 60 has a pressure-sealed interior 58 communicating through a selector valve 61 and pipe 62 with the tank 12, and through a selector valve 63 and pipe 64 with an intake line 65. The intake line 65 communicates via the by-pass pipe 21 and pressure valve 22 with the interior 57 in the bottom portion 48 of the housing 60.

The apparatus for transferring a fluid medium according to the invention operates in the following manner.

In the initial position the flexible pull member 15 and hose 13 are wound onto the drum 10. During starting the apparatus the selector valve 7 is opened and the valve 9 is closed. The selector valve 5 is also closed. Compressed gas flows from the compressed gas source 8 to the interior 4 and to the inside of the hose 13. The hose 13 and then the flexible pull member 15 start to reel off the drum 10. In the lowest position of the hose 13 its second end opens and the fluid medium flowing from the tank 12 through the filter element 16 enters the inside of the hose 13. After the liquid inside the hose 13 rises to a preselected level by a level control system (not shown, since it has no bearing on the subject matter of the invention and can have any known suitable form) a signal is issued to energize the electric motor, open the valve 9 and selector valve 5. The shaft 11 starts rotating to reel the flexible pull member 15 onto the drum 10. The second end of the hose 13 is drawn together to form a closed cavity inside the hose 13. In the course of hoisting the hose 13 the liquid present in the tank 12 enters through the filtering element 16 the interior of the bottom portion 3 of the housing 1 under the hose 13. As the hose 13 is raised the liquid is displaced therefrom to the intake line 6. The gas is released through the valve 9 to the atmosphere. After the hose 13 has been raised to a predetermined level, the electric motor is stopped, selector valve 7 is opened, valve 9 is closed, and compressed gas enters the interior 4 and the inside of the hose 13. As a result, the hose 13 exerts pressure on the liquid present in the interior of the bottom portion of the housing under the hose 13, whereby part of the liquid is forced through the filtering element 16 to wash clogged impurities therefrom and thereby clean the filtering element 16. Subsequent to the hose 13 assuming its lowest position the selector valve 7 is closed thus terminating the delivery of compressed gas to the interior 4, whereas the valve 9 is opened. The pressure inside the hose 13 tends to become less than the pressure of liquid under the hose 13. The second end of the hose opens, and the liquid rushes to the inside of the hose 13, whereupon the cycle is repeated. The valve 5 is closed after closing of the valve 7, and the flexible pull member 15 is again wound onto the drum 10.

Figure 2:
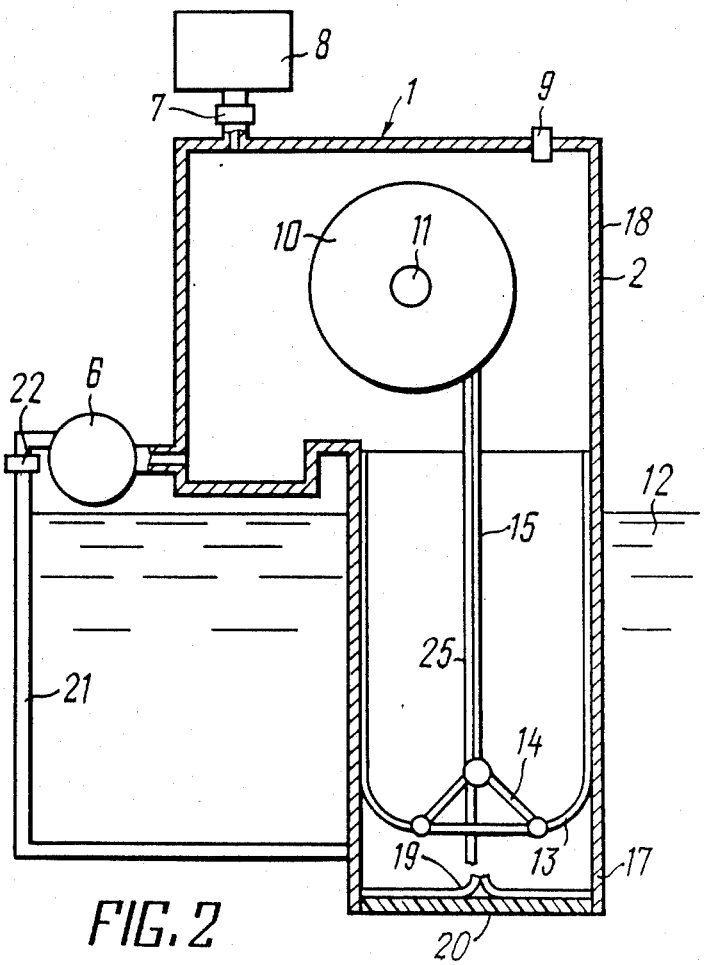
FIGS. 2 and 3 show the proposed apparatus with bypass pipes.

The modified forms of the proposed apparatus shown in FIGS. 2, 3 and 4 operate substantially in a similar manner. Because in these apparatuses the interior underlying the hose 13 is closed, and communicates with the tank 12 through the suction valve 19, lowering of the hose 13 causes the liquid present in this interior to be displaced to the by-pass pipe 21 to be conveyed through the pressure valve 22 to the intake line 6, which affords an increase in the efficiency of tranferring a liquid medium.

In the modification of the proposed apparatus (FIG. 6) where the end of pipe 30 is connected to the bottom portion 17 of the housing 18 above the second end of the hose 13 in its extended or unfolded state the movement of the hose 13 to close the by-pass pipe 30 causes cleaning of the filtering element 20 by the liquid being forced therethrough.

The embodiment of the proposed apparatus (FIG. 7) including the sections 31 and 32 having the drums 34 and 36 thereof mounted on the shafts 33 and 35 operates substantially similarly to what has been described heretofore. Rotation of the drum 36 causes elevation of the hose 13*a*. Concurrently, the valve 43 acts to switch over the source of compressed gas and communicate it with the top part of the housing 40 whereby the hose 13 is returned to the fully extended position ready for receiving a successive batch of the liquid being transferred.

The hose 13 is then raised by rotating the drum 34, whereas the valve 43 is switched over for feeding the compressed gas to the top portion of the housing 41 of the section 32 of the apparatus to cause unfolding of the hose 13*a*. In this manner the liquid is delivered alternately from the sections 31 and 32 of the apparatus to the intake line 6.

The employment of two liquid transferring sections provides a more efficient operation of the proposed apparatus and ensures a higher pressure of the fluid medium being pumped.

The modified form of the proposed apparatus (FIG. 8) with an additional hose operates as follows. Compressed gas is conveyed from the source 53 in the open position of the selector valve 55 to the cavity 52, whereas from the cavity 51 the gas is released to the atmosphere through the selector valve 54. The hoses 13 and 45 are moved jointly downwards of the housing 47, since their second ends are connected to the flexible pull member 50. As the hose 13 travels downwards, it acts to displace part of the liquid present in the interior 57 therefrom to the by-pass pipe 21 and force it through the pressure valve 22 to the intake line 6. In its lowest position the second end of the hose 13 opens and the liquid flows from the interior 57 to the inside of the hose 13. Gas is released from the cavity 52 through the selector valve 55. After the inside of the hose 13 is filled with the liquid, compressed gas is admitted from the source 53 through the selector valve 54 to the cavity 51, whereby the two hoses 13 and 45 start to ascend lengthwise of the housing 47, and the second end of the hose 13 is drawn together to form a closed cavity or volume. The liquid flows from the cavity 52 through the selector valve 5 to the intake line 6. The pressure valve 22 being meanwhile closed. The liquid present in the tank 12 is sucked in by an underpressure or vacuum developed in the interior 57 through the suction valve 19, upon which the whole cycle is recommenced.

With the closed housing 60 of the proposed apparatus (FIG. 9) the liquid is also transferred through the interior 58. The travel of the hoses 13 and 45 downwards causes an underpressure or vacuum in this interior 58, whereby the liquid present in the tank 12 is sucked in to the interior 58 by way of the pipe 62 and selector valve 61.

In the upward travel of the hoses 13 and 45 along the housing 60 the liquid flows through the open selector valve 63 to the pipe 64 and then to the intake line 65, the selector valve 61 being closed. After this the cycle is repeated.

The proposed apparatus can transfer substantial amounts of liquid or gas media. Within one stroke of the hose 3 having a diameter of 5 m up to 160 $m^3$ of gas or liquid can be transferred. The rate of such strokes executed by the hose depends on the power of the gas generator. Fabrication of the apparatus does not require the use of highly specialized or highly accurate equipment.

Another advantage of the proposed apparatus is its applicability for transferring highly contaminated liquids, such as fecal water. In addition, the apparatus can be used for transferring a fluid medium directly from wells 3000 m deep.

INDUSTRIAL APPLICABILITY

The invention can find application in lifting bodies of liquid from wells by positive displacement.

Another possible application of the apparatus according to the invention is for pumping-over bodies of water or oil from tanks by using the delivery pipe as a pressure chamber.

What is claimed is:

1. An apparatus for transferring a fluid medium comprising a housing (1) with an interior (4) at the top portion (2) thereof communicating through selector valves (5,9) with the atmosphere and with an intake line (6), the bottom portion (2) of the housing (1) accommodating an actuator capable of reciprocating relative to the bottom portion (2) of the housing (1) and blocking its cross-section, the actuator having a non-return valve communicating a tank (12) containing the fluid medium with the interior of the housing at the top portion thereof, characterized in that the actuator with the non-return valve is fashioned as an elastic hose (13) one end of which is hermetically attached to the perimeter of the wall of the bottom portion (2) of the housing (1), whereas the second end thereof is pivotably connected through link elements (14) equidistantly secured to its perimeter to a flexible pull member (15) extending through the elastic hose (13) and connected to a drive means to ensure that the second end of the elastic hose (13) can move toward the top portion (2) of the housing (1), this second end of the hose (13) tending to draw together in the course of such movement, the interior (4) of the top portion (2) of the housing (1) communicating with a source (8) of compressed gas to provide the movement of the second end of the elastic hose (13) in the reverse direction.

2. An apparatus as claimed in claim 1, characterized in that the bottom portion (3) of the housing (1) is longer than the length of travel of the elastic hose (13) and is separated from the tank (12) containing the fluid medium by a filtering element (16).

3. An apparatus as claimed in claim 1, characterized in that bottom portion of the housing is closed and communicates with the tank (12) containing the fluid medium through a suction valve (19), a bypass pipe (21) being provided one end of which is connected through a pressure valve (22) to the intake line (6) whereas the other end is connected to the bottom portion (17) of the housing (18) in proximity to the suction valve (19).

4. An apparatus as claimed in claim 3, characterized in that the suction valve (19) is provided with a filtering element (20).

5. An apparatus as claimed in claim 3, characterized in that the drive means for moving the second end of the elastic hose (13) includes an electric motor and a drum shaft (26) kinematically linked with the electric motor for reeling on the flexible pull member (15) and elastic hose (13), characterized in that the drum shaft (26) is hollow, the hollow of the drum (10) communicating with the intake line (6), whereas the by-pass pipe (25) is flexible and extends through the elastic hose (13), one end of the flexible by-pass pipe being disposed below the second end of the elastic hose (13), the other end thereof communicating with the hollow of the drum shaft (26).

6. An apparatus as claimed in claim 3, in which the second end of the by-pass pipe (30) is connected to the bottom portion of the housing (17) somewhat above the level at which the second end of the elastic hose (13) rests in the fully unfolded position.

7. An apparatus including two sections (31, 32) for transferring a fluid medium as defined in any of the preceding claims 1 to 6, characterized in that the drive means for moving the hoses (13) toward the top portion of the housing (40, 41) comprises two drums (34, 36) each arranged in a respective housing (40, 41), the drum shafts (33, 35) being coaxially arranged and kinematically interconnected, one of the shafts being connected to an electric motor.

8. An apparatus as claimed in claim 1, characterized in that the bottom portion (48) of the housing (47) is separated from the top portion (46) by a hermetically sealed partition wall (49), whereas the drive means for moving the second end of the elastic hose (13) is fashioned as an additional elastic hose (45) one end of which is turned inside out and attached to the periphery of the top portion (46) of the housing (47), the second end of this hose being threaded through the hermetically sealed partition wall (49) and connected to one end of the flexible pull member (50) having the second end thereof connected to the elastic hose (13), the cavities (51, 52) defined between the hermetically sealed partition wall (49) and elastic hoses (45, 13) communicating with the atmosphere and with the source (53) of compressed gas.

9. An apparatus as claimed in claim 8, characterized in that the top portion (59) of the housing (60) above the additional elastic hose (45) forms a hermetically sealed interior (58) communicating with the tank (12) containing the fluid medium and with the intake line (65).

* * * * *